United States Patent [19]

Kahlbacher

[11] 4,261,116

[45] Apr. 14, 1981

[54] SNOW REMOVAL APPARATUS

[76] Inventor: Anton Kahlbacher, Aschbachstrasse 8, 6370 Kitzbühel, Austria

[21] Appl. No.: 17,444

[22] Filed: Mar. 5, 1979

[30] Foreign Application Priority Data

Mar. 7, 1978 [AT] Austria ..... 1631/78

[51] Int. Cl.[3] ..... E01H 5/09

[52] U.S. Cl. ..... 37/43 R; 37/43 B; 37/43 C

[58] Field of Search ..... 37/43 R, 43 B, 43 C

[56] References Cited

U.S. PATENT DOCUMENTS

| | | | |
|---|---|---|---|
| 1,517,190 | 11/1924 | Bryan | 37/43 B |
| 1,698,901 | 1/1929 | Zinn | 37/43 C |
| 2,219,204 | 10/1940 | Wandscheer | 37/43 C |
| 3,085,832 | 4/1963 | Guillemette | 37/43 B |
| 3,461,578 | 8/1969 | Van Der Lely et al. | 37/43 B |

FOREIGN PATENT DOCUMENTS

| | | | |
|---|---|---|---|
| 640135 | 2/1962 | Canada | 37/43 C |
| 1284441 | 12/1968 | Fed. Rep. of Germany | 37/43 R |

*Primary Examiner*—Steven A. Bratlie

*Attorney, Agent, or Firm*—Toren, McGeady and Stanger

[57] ABSTRACT

In a snow-removing device including a slinger-wheel, the slinger-wheel is preceded by a cutting and conveying mechanism consisting of individual cutting-ejecting segments angularly spaced apart. Cutting elements ensure that wet or hard-frozen snow is broken up and cut loose. Conveying-ejecting elements pass the cut-up snow to the slinger-wheel and provide suitable preliminary acceleration of the snow. The ends of the conveying-ejecting elements are secured to two cutting elements displaced circumferentially in relation to each other by approximately 60° to 120°. Each cutting-ejecting segment comprises at least two conveying-ejecting elements with approximately constant radial spacing along their entire length.

5 Claims, 8 Drawing Figures

FIG. 1
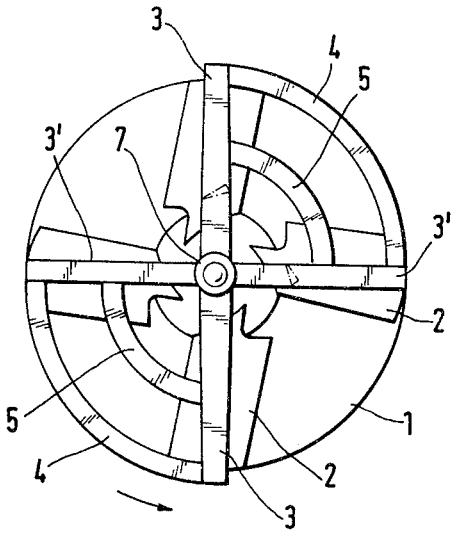
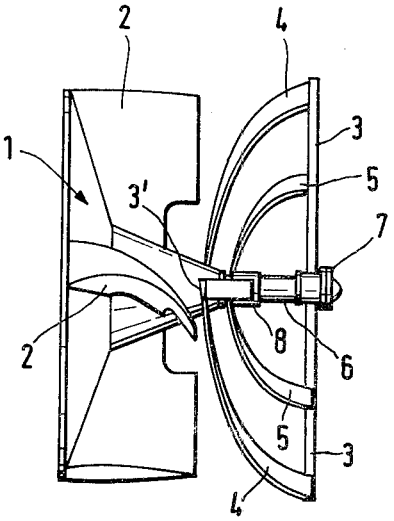
FIG. 3
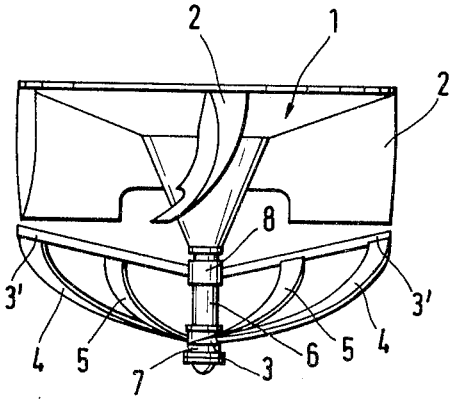
FIG. 2
FIG. 4
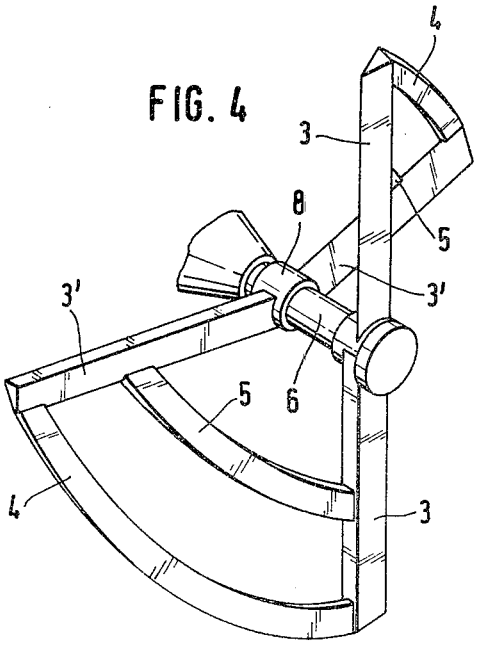

SNOW REMOVAL APPARATUS

The invention relates to a snow-removing device having a slinger-wheel with its axis of rotation running in the direction of snow-removal, and having a cutting and conveying mechanism ahead of the slinger-wheel, and at least two cutting elements in the form of arms extending approximately radially from the axis of rotation, separated axially, and displaced circumferentially, in relation to each other, as well as conveying-ejection elements running helically and having their terminal areas secured to the axially-displaced cutting elements.

A snow-removing device comprising a cutting element and a plurality of conveying elements is already known. However, the cutting and conveying elements are completely separate from each other and have no direct connection. The cutting element consists of two arms extending radially and staggered through 180° in relation to each other, the length of the arms being equal to about half the radius of the conveying elements. There is therefore scarcely any real breaking up of snow masses, since no cutting action is provided in the outer area which is precisely where the conveying elements are provided. Thus the freely-projecting ends of the conveying elements must dig into the solid snow. Therefore, a device of this kind very easily becomes blocked and comes to a halt. The arms carrying the conveying elements cannot be called cutting elements in this case, since in this area the snow has already been broken up. The arrangement of a plurality of cutting elements, which overlap considerably in the peripheral direction, impedes the free passage of snow, and no conveying action is therefore achieved. A device of this kind might be effective in light, loose snow, but certainly not in wet, hard-frozen snow.

Also known in a snow-removing device comprising two cutting elements arranged at 90° to each other and spaced axially from each other, the conveying elements being secured to two arms on these cutting elements and running at an angle of 270°. A device of this kind has given trouble with wet, heavy or hard-drozen snow, since snow builds up which applies high mechanical stresses to the entire device. Furthermore, this restricts the speed at which the vehicle can travel.

It is the purpose of the present invention to provide a snow-removing device whereby wet and hard-frozen snow may be fed quickly and with difficulty to the slinger-wheel.

According to the invention, this purpose is achieved in that the ends of the conveying-ejection elements are secured respectively to two consecutive cutting elements staggered in relation to each other by approximately 60° to 120°, for the purpose of forming an ejection segment, and in that at least two conveying-ejection elements are provided, each having an approximately constant radial spacing over their lengths.

The design according to the invention provides a substantially faster feed of snow, cut loose by the forward cutting elements, to the slinger-wheel. The conveying capacity is substantially increased by the increased pitch, so that even when the vehicle is travelling relatively fast, there is no build-up in front of the device. By arranging the conveying-ejection members at least in pairs, improved conveying and ejection is obtained, since the members have a larger angle of attack. In spite of this, however, it is still possible for some snow to pass between conveying-ejection members. The arrangement of separate conveying-ejection members also provides the advantage of allowing them to be made resilient, and this enables them to absorb impact-loading without difficulty.

Additional characteristics and advantages of the invention are explained hereinafter in greater detail, in conjunction with the drawings attached hereto, wherein:

FIG. 1 is a front elevation of the snow-removing device in which, for the sake of clarity, only the slinger-wheel and the cutting and conveying mechanism are shown;

FIG. 2 is a side elevation according to FIG. 1;

FIG. 3 is a plan view according to FIG. 1;

FIG. 4 is an oblique view of the snow-removing device;

Figure 5:
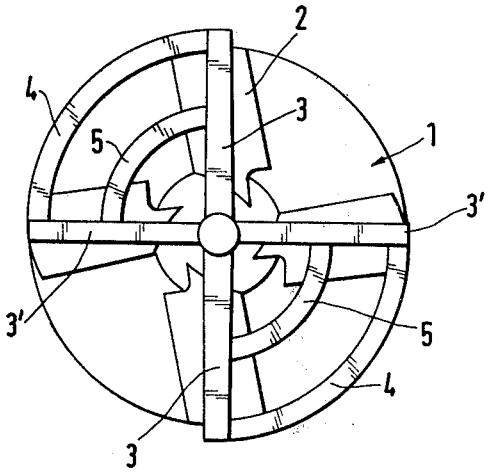
FIG. 5 is a view according to FIG. 1, but with a different direction of rotation.

The snow-removing device illustrated consists essentially of an ejector or slinger-wheel 1 with appropriately arranged ejector scoops 2, cutting elements 3,3', and conveying-ejection members 4,5, the cutting elements 3,3' and conveying-ejection members 4,5 constituting a cutting and conveying mechanism, located ahead of slinger-wheel 1.

Cutting elements 3,3' are in the form of arms extending approximately radially from the axis of rotation, being arranged upon a tube connected permanently to slinger-wheel 1.

In the example of embodiment illustrated, two cutting elements 3 are arranged opposite each other. Rear cutting elements 3', facing slinger-wheel 1, are spaced axially from front cutting elements 3. Furthermore, the rear cutting elements are staggered angularly around the axis of rotation in relation to the front cutting elements. As seen in the direction of rotation therefore, a front cutting element 3 is followed at approximately 90° by a rear cutting element 3'. Conveying-ejection elements 4,5 run almot helically, the ends thereof being secured to axially separated cutting elements 3,3'.

In the example of embodiment illustrated in the drawings, the ends of conveying-ejection members 4,5 are secured to cutting elements 3 which are separated axially and are directly consecutive peripherally, the elements being therefore arranged over a 90° stretch of the periphery, i.e. over about one quarter of a segment.

Conveying-ejection elements 4 are secured to the radially outer ends of cutting elements 3,3'. Inner conveying-ejection elements 5 are arranged in the outer halves of the radial extension of cutting elements 3,3'. This allows satisfactory removal and conveying of snow masses, precisely in the outer peripheral area of the cutting and conveying mechanism. Obviously other conveying-ejection elements are conceivable within the scope of the invention. For example, it would be possible to adapt the spacing of the parallel conveying-ejection elements, and also the angle of consecutive, staggered cutting elements 3, according to the type of snow.

Figure 6:
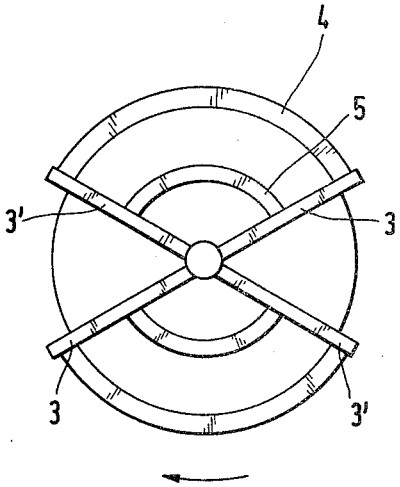
FIGS. 6 to 8 are front elevations of further examples of embodiment of the snow-removing device according to the invention.
Figure 7:
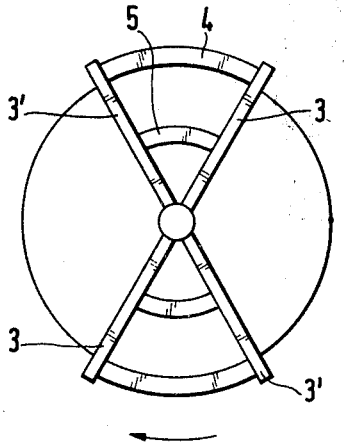
Figure 8:
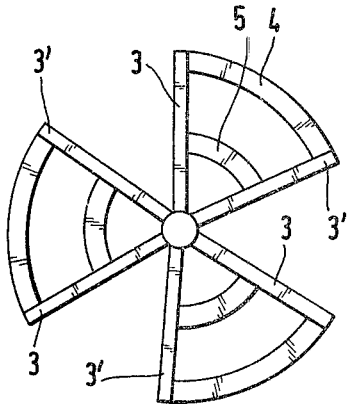

In the example according to FIGS. 1 to 5, conveying-ejection elements 4,5 extend over almost 90° of the circumferential periphery. However, it is conceivable for this angle to be between 60° and 120°, thus providing adaptation to the speed of the vehicle, the r.p.m. of the slinger-wheel, and the amount of snow to be removed (see also FIGS. 6 to 8).

In the example of embodiment illustrated in FIGS. 1 to 5, two front cutting elements 3 enclosing an angle of 180°, and two rear cutting elements 3', staggered at 90° thereto, are provided. It is, of course, also conceivable to provide four such cutting elements, displaced thrugh 90° to each other, so that in practice front cutting elements 3 coincide with rear cutting elements 3'. In this case, conveying-ejection elements 4,5 would then be secured between two front and rear cutting elements 3,3' arranged at 90° to each other. It would also be conceivable, within the scope of the invention, to provide an odd number of cutting elements 3 (see FIG. 8), so that cutting elements 3,3' would consist of three arms at 120° to each other. In this case rear cutting elements 3' would be displaced only through 60° in relation to front cutting elements 3, however these elements could also be arranged to coincide with front cutting elements 3, in which case the conveying-ejection elements would be at an angle of 120°. It was found, however, to be most expedient to provide a free passage between the cutting-ejecting segments, so that the amounts of snow to be passed through can be substantially increased.

According to one specific design, it was found desirable to run slinger-wheel 1, and thus the cutting and conveying mechanisn also, at between 300 and 400 r.p.m.. It as also found desirable to make the axial distance between cutting elements 3,3' less then half their radial extension. A design of this kind allows the vehicle to travel at 20 km/h, with no buildup in front of the snow-remover. This is, of course, merely a design suggestion which may be varied as required.

Cutting elements 3 may be secured to support tube 6 in a variety of ways. It is desirable, however, for a flange 7, provided to hold front cutting elements 3, to be connected to the said tube by means of a shear-pin, thus preventing damage should the device encounter an obstacle. In the example of embodiment illustrated, an annular sleeve 8 may be axially displaceable upon support tube 6 in order to equalize the loads on conveying elements 4,5 and cutting elements 3,3'. Other designs providing protection against overloading are, of course, also conceivable.

The design illustrated has been found highly satisfactory, the arrangement comprising pairs of conveying-ejection elements 4,5, extending in two or three segments over about 60 to 120° providing a relatively large free space for the passage of the snow from front cutting elements 3 to the slinger-wheel. This allows relatively large lumps of snow, in particular, when the snow is wet, to be fed without difficulty to the slinger ring.

It may also be gathered from the drawings that the free ends of cutting elements 3' associated with the slinger-wheel are inclined at an acute angle to the axis of rotation, towards the slinger-wheel. As a result of this, the conveying-ejection elements acquire a steeper pitch for a given angular displacement of the cutting elements, and the pitch of the conveying elements, running parallel with each other, is also different. The result of this is an increase in conveying velocity. It has also been found that the feed to the slinger-wheel is thus improved, so that the snow in the outer part of the conveying mechanism can be brought close to the slinger-wheel.

According to still another characteristic, front cutting elements 3 are longer than cutting elements 3' associated with the slinger-wheel, and conveying-ejection members 4,5 run not only helically but also spirally. This provides a relatively wide front cutting area, whence the parts of the conveying mechanism taper rearwardly. This arrangement also contributes substantially to the prevention of any build-up at the snow inlet, even when the vehicle is travelling at high speed.

The invention provides partial cutting, conveying and ejecting segments which, in the example illustrated may be termed "quarter" or "sixth cutting elements". This therefore leaves two "quarter" or "sixth apertures" allowing free passage for the snow. At the same time, the cutting-ejecting segments take this snow over and direct it to the scoops of the slinger-wheel.

The snow-removing device according to the invention is ideally suited for airports, highways etc., where large volumes of snow must be moved quickly. This usually means very wet and heavy snow which blocks up hitherto-known slinger-wheels and ejection stacks. The cutting and conveying mechanism according to the invention is the first to solve this problem satisfactorily.

Slinger-wheel 1 has large open surfaces, since ejector scoops 2 are inside and the shear-pin safety device is behind the slinger-wheel. A feed plough may be fitted in the form of a roller, so that the snow can be fed in a rolling motion to the slinger-wheel.

In the examples of embodiment illustrated in FIGS. 1 to 7, four ejector scoops are associated with slinger-wheel 1. Some other number is, of course, also conceivable. Where three cutting-ejecting segments are provided, it has been found desirable to use three ejector scoops 2, with the cuttting-ejecting segments staggered slightly in relation to ejector scoops 2, so that the snow is fed thereto following continuously the helical or spiral configuration thereof. Depending upon the nature of the snow, it would also be conceivable to provide a means of adjustment between slinger-wheel 1 and the cutting-ejecting segments.

The embodiments of the invention in which an exclusive property or privilege is claimed are defined as follows:

1. A snow-removing device having a rotatable slinger-wheel with the axis of rotation of said slinger-wheel extending in the direction of snow-removal, a cutting and conveying mechanism positioned ahead of the said slinger-wheel in the direction of the axis of rotation and at least two cutting elements in the form of arms extendling approximately radially from the said axis of rotation, said cutting elements spaced apart in the direction of the axis of rotation and spaced angularly apart around the axis of rotation; and helically extending conveying-ejection elements and with each end thereof secured to a different one of said cutting elements, characterized in that the ends of the conveying-ejection elements are secured to two angularly consecutive cutting elements spaced apart in the direction of the axis of rotation and spaced angularly apart around the axis of rotation in the range of displaced in relation to each approximately 60° to 120°, an ejection segment comprising said cutting elements and said conveying-ejection elements secured thereto, and said ejection segment comprising at least two conveying-ejection elements spaced radially outwardly from the axis of rotation and said at least two conveying-ejection elements being approximately equal spaced apart in the radial direction from the axis of rotation over the entire length thereof between said cutting elements.

2. A snow-removing device according to claim 1, characterized in that said conveying-ejection elements in one said ejection segment comprises an outer conveying-ejection element secured to the radially outer ends of said cutting elements, and an inner conveying-ejection element, and said outer and inner conveying-ejection elements being arranged in the outer half of the radial extention of the said cutting elements.

3. A snow-removing device according to claim 1, characterized in that the ends of said conveying-ejection elements are secured to consecutive said cutting elements spaced circumferentially apart by about 60°.

4. A snow-removing device according to claims 1, 2 or 3, characterized in that the axial distance between said cutting elements in said ejection segment is less than half the radial length thereof.

5. A snow-removing device according to claim 4, characterized in that each said ejection segment comprises a front said cutting element and a rear said cutting element with said front cutting element being spaced further in the direction axis of rotation from said slinger wheel than said rear cutting element, and said conveying-ejection elements secured between said front and rear cutting elements run helically and spirally around the axis of rotation.

* * * * *